United States Patent [19]

Murphy et al.

[11] Patent Number: 4,930,652

[45] Date of Patent: Jun. 5, 1990

[54] DRINKING/DISPENSING DEVICE FOR BEVERAGE CONTAINERS

[75] Inventors: Peter F. Murphy, Gross Pointe; James H. Kurtz, Jr., Grosse Pointe Farms, both of Mich.

[73] Assignee: MK Industries, Grosse Pointe Farms, Mich.

[21] Appl. No.: 347,171

[22] Filed: May 3, 1989

[51] Int. Cl.[5] ..... B65D 47/06

[52] U.S. Cl. ..... 220/90.2; 229/103.1; 215/1 A

[58] Field of Search ..... 220/90.2, 90.4; 229/103.1; 215/1 A

[56] References Cited

U.S. PATENT DOCUMENTS

| | | | |
|---|---|---|---|
| 3,295,715 | 1/1967 | Pugh . | |
| 3,547,308 | 12/1970 | Gilliem . | |
| 3,656,654 | 4/1972 | Brinkley, III . | |
| 3,717,476 | 2/1973 | Harvey . | |
| 3,746,197 | 7/1973 | Sather . | |
| 3,946,895 | 3/1976 | Pugh . | |
| 4,078,692 | 3/1978 | Stein . | |
| 4,109,817 | 8/1978 | Payne et al. . | |
| 4,226,356 | 10/1980 | Lemelson . | |
| 4,228,913 | 10/1980 | Mack et al. . | |
| 4,305,521 | 12/1981 | Komatsuta et al. . | |
| 4,356,927 | 11/1982 | Cooper et al. . | |
| 4,424,913 | 1/1984 | Ko . | |
| 4,462,503 | 7/1984 | Di Raffaele et al. . | |
| 4,537,324 | 8/1985 | Wang . | |
| 4,561,557 | 12/1985 | Park et al. . | |
| 4,582,213 | 4/1986 | Park et al. . | |
| 4,690,294 | 9/1987 | Jones . | |
| 4,709,829 | 12/1987 | Johnson et al. . | |
| 4,712,702 | 12/1987 | Ayabe et al. . | |
| 4,728,001 | 3/1988 | Serba . | |
| 4,826,034 | 5/1989 | Forbes | 220/90.2 |
| 4,842,157 | 6/1989 | Stone-Parker et al. | 220/90.2 |

*Primary Examiner*—David T. Fidei

*Attorney, Agent, or Firm*—Harness, Dickey & Pierce

[57] ABSTRACT

The present invention is a device for a container. The container includes a tubular body having a closed end, an open end and a longitudinal axis. A lid is secured to the open end and having an orifice. A closure tab is pivotally connected to the lid and temporarily closes the orifice. An actuating member is pivotally secured to the lid and is being manually actuated for moving the closure tab into the interior of the body to open the orifice in the lid. The device includes a conduit disposed within the body. A means is disposed within the body and adapted to engage the body for supporting the conduit substantially parallel to the longitudinal axis of the body. Another means forms a float for elevating the conduit through the orifice in the lid when liquid is present within the body and the tab is deflected into the interior of the body to open the orifice. The device may include means for rotating the conduit to align the conduit with the orifice of the lid when the closure tab is deflected into the body to open the orifice by the actuating member.

21 Claims, 3 Drawing Sheets

DRINKING/DISPENSING DEVICE FOR BEVERAGE CONTAINERS

BACKGROUND OF THE INVENTION

1. Field of the Invention

The present invention relates generally to a container having a drinking tube incorporated therein and, more particularly, to a beverage container having a pop-up drinking/dispensing tube.

2. Description of Related Art

Currently, beverage containers are manufactured, fitted and sealed in a high-speed automated process. This process includes manufacturing a separate body for containing the fluid or beverage and a separate lid for sealing the open end of the body. During manufacture of the beverage container, a manufacturing operation known as "seaming" places the lid on a filled can body and seals its perimeter. At present, known seaming operations slide the lids horizontally across the top of the beverage containers at a vertical distance of only a few millimeters above the top edge of the beverage container. The seaming operation involves the use of very expensive high-speed machinery and tooling.

Previously, there have been attempts to provide a drinking/dispensing tube device such as a straw in beverage containers. An example is disclosed in U.S. Pat. No. 4,728,001, issued Mar. 1, 1988, for inventor Serba. In this patent, the drinking straw floats on top of the beverage and has its ends bent at an angle to allow removal. However, a disadvantage with this patented device is that the end user must attempt to manually rotate the straw into position beneath the orifice by inserting a finger or other object through the sharp orifice into the container body interior. Once the straw has been positioned, the user must then grab the straw, pull it out through the orifice, straighten its convolutes, then reinsert the straw back into the container body.

Another example of a drinking/dispensing tube device is disclosed in U.S. Pat. No. 4,109,817, issued Aug. 29, 1978, for inventors Payne et al. This patent discloses a straw assembly for a liquid container in which a straw has a float mounted on its bottom end to use through the orifice once the pull tab closure is removed. However, one disadvantage of this patented device is that the seaming process must be changed such that the lid orifice position is aligned with the straw. Such aligning is not current practice and may not be commercially feasible. Another disadvantage is that the device requires a style of lid which is now obsolete due to environmental and safety reasons. A lid whose tab closure is completely removed and separated from the lid by the end-user during opening of the beverage container.

It is one object of the present invention to provide a straw or drinking/dispensing tube or the like for use in beverage containers as the containers are shipped in a sealed condition from bottling or canning factories.

It is another object of the present invention to eliminate the need for end-users to manually insert drinking straws into beverage containers.

It is a further object of the present invention to provide manufacturers and consumers of existing beverage containers with a drinking/dispensing device which can be integrated with the basic beverage container.

It is another object of the present invention to provide a more sanitary beverage drinking/dispensing device than is currently available under known existing beverage containers.

It is a further object of the present invention to provide a device which can be inserted into a beverage container for the purpose of moving a straw which is contained within the interior of the beverage container so that the straw becomes aligned with the orifice of the container lid in such a way as to render the straw accessible for upward extension and/or removal from the container through the orifice.

It is a still further object of the present invention to cause the downward vertical motion of a beverage lid's closure tab (as it is being opened) to move the straw into a position directly beneath the lid's orifice.

It is another object of the present invention to provide a mechanism which can be inserted into a beverage container for the purpose of elevating a straw so that the straw protrudes out through an orifice in the top of a beverage container.

It is a further object of the present invention to facilitate the drinking and/or dispensing of beverages by children and/or handicapped or elderly adults whose motor skills cannot attain the same level of control and precision as normal adults.

It is a still further object of the present invention to help minimize or eliminate waste spillage of the beverage which can occur as a result of sloppy drinking and/or dispensing practices or as a result of environmental difficulties such as those present during a bumpy car, plane or train ride.

It is another object of the present invention to provide in a beverage container a straw which embodies compressed circumferential folds or convoluted ridges or rings which enable the straw's length to be increased or decreased by extension or further compression of the folds or ridges, and which enable the straw to be bent at an angle without causing the kind of collapse in its wall which would obstruct the flow of the beverage through the straw.

It is a further object of the present invention to provide in a beverage container a straw which is capable of being bent at an angle or about a radius and then remain shaped and functional at that angle or radius without the aid of any external force or external molding or shaping apparatus which is additional to the initial force or apparatus required to first form the bend.

SUMMARY OF THE INVENTION

Accordingly, the present invention is a device for a container. The container includes a tubular body having a closed end, an open end and a longitudinal axis. A lid is secured to the open end and having an orifice. A closure tab is pivotally connected to the lid and temporarily closes the orifice. An actuating member is pivotally secured to the lid and is being manually actuated for moving the closure tab into the interior of the body to open the orifice in the lid. The device includes a conduit disposed within the body. A means is disposed within the body and adapted to engage the body for supporting the conduit substantially parallel to the longitudinal axis of the body. Another means forms a float for elevating the conduit through the orifice in the lid when liquid is present within the body and the tab is deflected into the interior of the body to open the orifice.

DESCRIPTION OF THE PREFERRED EMBODIMENT

Figure 1:
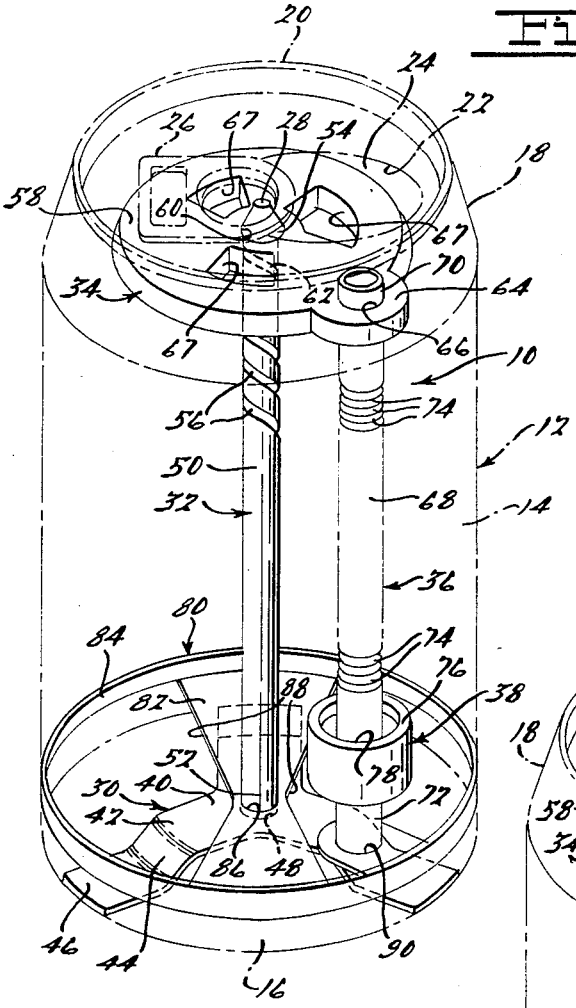
FIG. 1 is a perspective view of a drinking/dispensing device constructed in accordance with the principles of the present invention for a beverage container shown in phantom lines.
Figure 2:
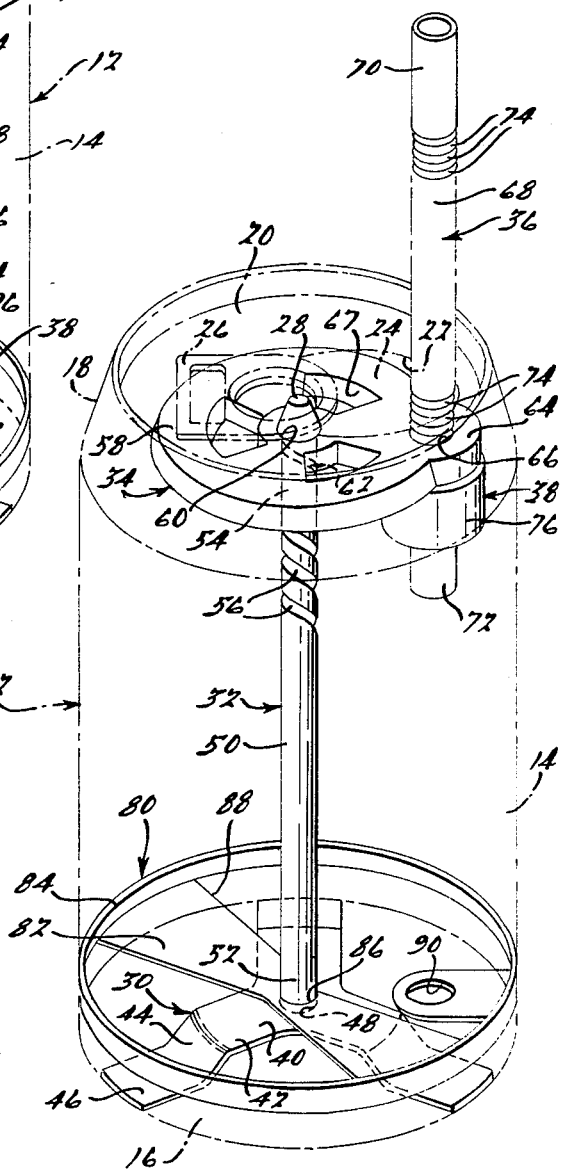
FIG. 2 is a view similar to FIG. 1 with a straw extending through an orifice in a lid of the beverage container.

Referring to FIGS. 1 and 2, a drinking/dispensing device 10 for a beverage container, generally indicated at 12, is shown. The beverage container 12 includes a generally cylindrical and tubular container body 14 having a lower or bottom closed end 16 and an upper or top open end 18. The body 14 is generally circular in cross-section. The beverage container 12 also includes a generally circular container lid 20 to close the open end 18. It should be appreciated that the body 14 and lid 20 are made of metal such as aluminum. It should also be appreciated that the lid 20 is secured to the body 14 by conventional seaming processes.

The lid 20 has a generally circular or elliptical orifice 22 which is temporarily closed by a closure tab 24. The lid 20 also has an actuating member 26 pivotally connected to the lid 20 which is rotated to press or deflect the closure tab 24 downward into the interior of the body 14 to open the orifice 22 for allowing fluid or beverage to be dispensed. A rivet 28 secures the actuating member 26 to the lid 20.

The device 10 includes a base mount 30, drive stem 32, drive disc 34, straw 36 and float 38. Each component of the device 10 and the whole device 10 are designed to minimize the cost of manufacture and insertion, to minimize its volumetric displacement, and to facilitate the motions of the straw and the flow of beverage.

The base mount 30 is disposed at the bottom or closed end 16 of the body 12. The base mount 30 has a base 40 which is generally a horizontal plate. The base mount 30 also has a plurality of, preferably three, legs 42 equally spaced and extending radially outwardly about the base 40. The legs 42 have a downwardly extending portion 44 and a radially outwardly extending foot portion 46 such that the base 40 is elevated or disposed above a plane formed by the foot portions 46. The base mount 30 further has a generally circular aperture 48 communicating axially through the base 40.

It should be appreciated that the device 10 will usually be installed in the container 12 after the top or open end 18 of the body 14 has been necked to accept a lid 20 whose diameter is smaller than the diameter of the container 12 at its largest point. Therefore, the base mount 30 is constructed so that its effective outside diameter will reduce in size by the legs 42 flexing upward along the interior perimeter of the body 14 when it encounters interference as downward force is applied to the base 40 of the base mount 30 during the process of inserting the device 10 past the necked open end 18 of the beverage container 12. Once the base mount 30 has been inserted past or below the necked open end 18 of the body 14, the legs 42 of the base mount 30 then re-extend to their original diameter so the base mount 30 can fit snugly against the inner side walls of the body 14 near the bottom or closed end 16 of the body 14.

The drive stem 32 extends upwardly from the base mount 30. The drive stem 32 is generally a cylindrical rod 50 having a first end 52 disposed in the aperture 48 of the base 42 and secured thereto by means such as press-fitting. The rod 50 of the drive stem 32 extends vertically upwardly toward the lid 20 and has a second end 54 terminating just below the lid 20. To help maintain vertical alignment of the drive stem 32, the tip of the second end 54 of the drive stem 32 may be chamfered to fit into a center dimple of the rivet 28 for the lid 20. The second end 54 of the drive stem 32 includes a plurality of raised flights 56 which wrap around the root diameter of the rod 50 in a spiralling pattern for a function to be described. It should be appreciated that the drive stem 32 and base mount 30 may be formed as an integral unit.

The drive disc 34 is disposed about the second end 54 of the drive stem 32. The drive disc 34 is a generally circular plate or spool 58 having a generally circular aperture 60 extending axially through the plate 58. It should be appreciated that the aperture 60 could have a "star" shape. The aperture 60 includes a groove 62 extending around the circumference thereof in a spiralling pattern of the same pitch as the raised flights 56 on the drive stem 32 for mating with the raised flights 56. The drive disc 34 also includes a flange 64 extending radially outwardly from a portion of the outer surface of the plate 58. The flange 64 includes a generally circular positioning aperture 66 extending axially through it. The drive disc 34 includes at least one, preferable a plurality of apertures 67 extending axially therethrough to enable the liquid beverage to pass through during filling and/or removal of liquid from the container 12.

The straw 36 is a generally tubular conduit 68. The straw 36 has a first end 70 extending vertically upwardly through the aperture 66 and above the upper surface of the flange 64. The straw 36 has a second end 72 which extends vertically downwardly through the float 38 to be described. The straw 36 may also include convolutes 74 near the first and second ends 70 and 72 and/or throughout to allow the ends to be positioned at an angle relative to the remaining portion of the conduit 68. Preferably, the straw 36 is made of a plastic material. The configuration at the top of the first end 70 of the straw 36 is designed to glide along the lower or interior surface of the lid 20 such that the straw 36 can successfully reach the location of the orifice 22. In alternative embodiments of the present invention, the lid 20 and/or bottom closed end 16 of the container 12 may be designed to enhance the rotary movement and/or positioning of the straw 36 at the proper exit location directly beneath the orifice 22 of the lid 20.

The float 38 is adapted to be disposed about the straw 36. The float 38 is a generally elongated cylinder 76 having an aperture 78 extending axially through it. It should be appreciated that the float 38 could be formed as a plannar or flat washer. The float 38 is made of a material having a density less than the density of the fluid to exert an upward force upon the straw 36 whenever there is sufficient beverage present in the container 12. The float 38 is designed and attached to or integrated with the straw 36 so that the float 38 remains intact trapped beneath the container lid 20 as a safety precaution. In the event the end-user completely removes the straw 36 from the opened beverage container 12, then the float 38 cannot be accidentally ingested by the end-user.

Optionally, the device 10 may include a stabilizing carrousel, generally indicated at 80. The stabilizing carrousel 80 may be used where the drive disc 34 does not sufficiently stabilize and maintain the straw 36 in a position which is parallel to the inner side walls of the beverage container 12. The carrousel 80 is a generally circular plate 82 and may have a ring member 84 disposed about the circumference of the circular plate 82. The ring member 84 of the carrousel 80 has an outer diameter slightly less than the inner diameter of the body 14. The plate 82 has a generally circular aperture 86 extending axially therethrough and is disposed about the rod 50 of the drive stem 32 so that the carrousel 80 can rotate in concert with the straw 36 and drive disc 34 to help maintain the position of the straw 36 parallel to the side walls of the body 14. The carrousel 80 includes a plurality of apertures, slits, slots and/or gaps 88 to enable the liquid beverage to pass through the plate 82 during filling and/or removal of liquid from the container 12 and to minimize the buoyancy of the carrousel 80. The plate 82 also has a generally circular aperture 90 through which the second end 72 of the straw 36 may extend. The aperture 90 positions the straw 36 relative to the carrousel 80.

The carrousel 80 may also be streamlined with chamfered or rounded horizontal edges to reduce horizontal drag as it rotates through the beverage. The outer edges of the ring member 84 are streamlined to minimize friction when they contact the inner side walls of the body 14 of the beverage container 12. The vertical edges of the gaps 88 may be bevelled or otherwise streamlined to enhance the beverage filling process in those situations where the container 12 is filled after the device 10 has been installed. When the container 12 is filled before the device 10 has been installed, these vertical edges may be bevelled or otherwise streamlined to facilitate insertion of the device 10 down into the liquid without causing the liquid to overflow the body 14 of the container 12.

To prevent the float 38 from elevating the straw 36 during the seaming operation, a small amount of biologically safe (United States Food & Drug Administration approved) soluble gelatin or binder can be used to temporarily bond the straw 36 to the inside perimeter face of the aperture 66 of drive disc 34 and/or aperture 90 of the carrousel 80. The bond will be designed to hold the straw 36 for the longest period of time which could be expected to elapse beginning at the time the bond is initially exposed to dissolving moisture during the beverage container washing or filling operation until the time that the seaming operation has been completed. Once seaming is complete, the bond will dissolve.

As an alternative to the dissolving gelatin or binder bond, a thixotropic gel or emulsion may be used to contain the straw 36 within the aperture 66 of drive disc 34 and/or aperture 90 of the carrousel 80; until such time as the thixotropic material's grip on the straw 36 is loosened either by external agitation of the beverage container 12 by the end-user prior to opening of the container 12 or by the agitation which occurs during the container 12 opening process.

As an alternative to the gelatin or binder bond, a hygroscopic material may be used to contain the straw 36 within the aperture 66 of drive disc 34 and/or aperture 90 of the carrousel 80, until such time as the material absorbs sufficient moisture to expand away from the straw 36 and thereby permit the float 38 to elevate the straw 36 until the straw 36 contacts the lid 20. The time required for the hygroscopic material to fully loosen the straw 36 would be slightly greater than the maximum time required for washing, filling, and seaming of the beverage container 12.

As an alternative to the adhesion bonds discussed above, a small plate (not shown) could be positioned directly above the straw 36 or float 38. The plate would prevent the float 38 from elevating the straw 36 until the plate had first been removed from the upward path of the straw 36 or float 38 either directly by the turning of the drive disc 34 and/or carrousel 80 or indirectly by the turning of the drive disc 34 and/or carrousel 80 in conjunction with a cam or gear system (not shown). The rotary motion of the drive disc 34 and/or carrousel 80 would be transferred into a sliding motion to remove the plate from the top of the straw 36 or float 38, thereby providing clear access for the float 38 to elevate the straw 36 toward the lid 20 and/or out through the orifice 22.

As an alternative to the adhesion bonds or the small plate discussed above, a mechanical seal (not shown) could be provided about the perimeter of the straw 36 at the point where the straw 36 intersects the drive disc 34 and/or carrousel 80. Such a seal would exert the necessary downward force to counteract the upward force of the float 38 during the filling and/or seaming processes. Introduction of pressure during the final stages of seaming, spinning and/or shaking of the can after seaming could then reverse, reduce, or eliminate the effect of the mechanical seal, allowing the float 38 to successfully raise the straw 36. Alternatively, the mechanical seal could be negated by a slight finger tap on the top of the straw 36 by the end-user after the closure tab 24 had been opened and the straw 36 had become positioned beneath the orifice 22. It should also be appreciated that the bottom of the float 38 may be temporarily bonded to the top of the carrousel 80.

Figure 3:
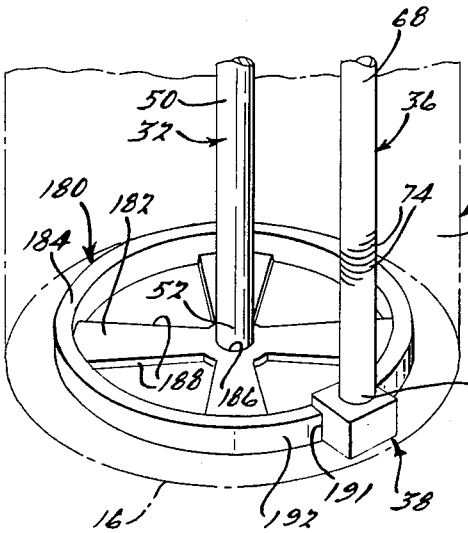
FIG. 3 is a partial perspective view of an alternate embodiment of a carrousel for the device shown in FIGS. 1 and 2.

Referring to FIG. 3, a different or alternative optional stabilizing carrousel 180 may be used. Like parts of the device 10 have like numerals increased by one hundred (100). The carrousel 180 may be secured to the drive stem 132 so that the carrousel 180 cannot rotate. The base mount 30 may be eliminated such that the carrousel 180 may rest on the interior surface of the bottom closed end 16 of the body 14. The radius of the carrousel 180 would be less than the inside radius of the body 14 by a distance slightly less than the horizontal width of an alternate float 138. This float 138 would maintain the position of the straw 36 between the carrousel 180 and the inner side walls of the body 14 of the container 12 as the straw 36 is rotated about the longitudinal axis of the rod 50 of the drive stem 32. The float 138 is generally rectangular in shape and has a generally inner arcuate and vertical face 191 constructed to slide easily around the outer arcuate and vertical face 192 of the ring member 184 of the carrousel 180. The faces 191 and 192 may be stepped, radiused rabbetted or tongue-and-grooved to provide additional alignment stability and/or ease of rotation. It should be appreciated that the optional stabilizing carrousel 180 also adds an additional stabilizing force to keep the drive stem 132 parallel to the inner side walls of the beverage container 12. Alternatively, depending on the nature of the container 12 and of the beverage, this stabilizing force could be sufficient to eliminate the need for the base mount 30.

In operation, when the closure tab 24 of the beverage container 12 is torn and subsequently flexed downward into the interior of the body 14, the tab 24 contacts the drive disc 34 and forces the drive disc 34 downward. As the drive disc 34 travels downward, it rotates horizontally about the drive stem 32 by means of the raised flights 56 mating with the groove 62 of the drive disc 34. The rotary motion of the drive disc 34 causes the straw 36 to rotate because the straw 36, which is rigid, is positioned in the positioning aperture 66 of the drive disc 34 and must therefore travel with the drive disc 34 as the drive disc 34 moves. The straw 36 continues to rotate with the drive disc 34 until the top of the straw 36 reaches the position where it is directly beneath the open orifice 22 in the lid 20. Since the density of the float 38 is less than the density of the beverage, the float 38 exerts an upward force upon the straw 36. When the counteracting downward force of the lid 20 is removed, as is the case at the moment when the straw 36 has rotated to reach the position directly beneath the open orifice 22, the float 38 elevates the straw 36 upward so that the first end 70 of the straw 36 protrudes out through the top of the lid 20 through the open orifice 22.

Figure 4:
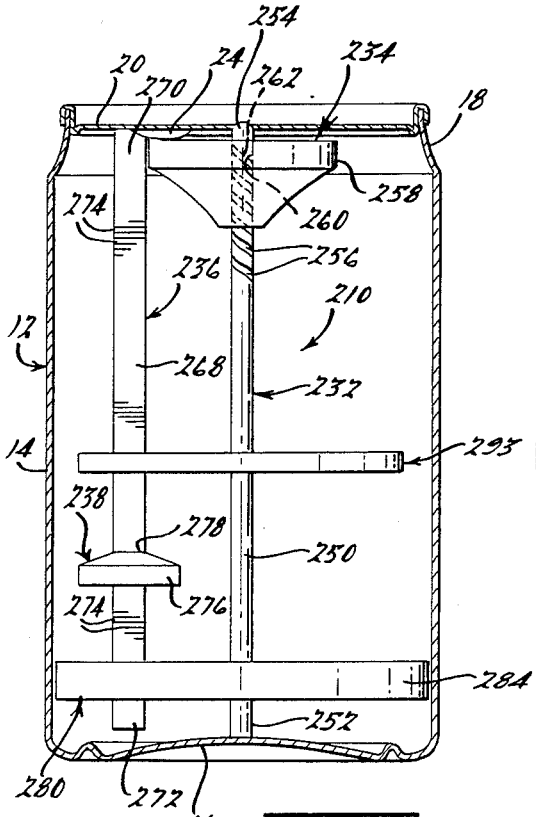
FIG. 4 is an elevational view of a first alternate embodiment of the device shown in FIGS. 1 and 2 with the beverage container shown in section.

Referring to FIG. 4, a first alternative embodiment 210 of the device 10 is shown. Like parts of the device 10 have like numerals increased by two hundred (200). In the device 210, the base mount is eliminated. The drive stem 232 is secured to a main carrousel, generally indicated at 293. The main carrousel 293 is similar to the stabilizing carrousel 280 but has a diameter less than the diameter of the stabilizing carrousel 280. The first end 252 of the drive stem 232 rests on the interior surface of the bottom closed end 16 of the body 14. The float 238 is disposed about the straw 236 beneath the main carrousel 293. The float 238 has an outer diameter greater than the diameter of a positioning aperture (not shown) of the main carrousel 293 to prevent the float 238 from moving past or above the main carrousel 293. The drive disc 234 extends axially along the second end 254 of the drive stem 232 to present a trapezoidal profile. It should be appreciated that the drive disc 234 could have any suitable shaped profile. The second end 254 of the drive stem 232 has the raised flights 256 while the aperture 260 of the drive disc 234 has the mating groove 262. It should be appreciated that the drive stem 232 may be formed from a plastic strip which is heated and twisted to form the desired shape suitable. The drive disc 234 does not have a flange with a positioning aperture. Unlike the device 10, the drive disc 234 does not rotate, but the drive stem 232 does rotate. A primary reason for this alternative is the existence of closure tabs 24 which might not readily slip across the top surface of a rotating drive disc 234 as the tab 24 descended.

In operation, when the closure tab 24 is torn and subsequently flexed downward into the interior of the body 14 of the container 12, the tab 24 contacts the drive disc 234 and forces the drive disc 234 downward. This downward motion of the drive disc 234 is then converted into a rotary motion of the drive stem 232 by means of the raised flights 256.

The rotary motion of the drive stem 232 causes the main carrousel 293 to rotate because the main carrousel 293 is an integral part of the drive stem 232 or is mechanically or chemically fastened to the drive stem 232. The main carrousel 293, in turn, causes the straw 236 to rotate because the straw 236, which is rigid, is positioned in the positioning aperture of the main carrousel 293 and must therefore travel with the main carrousel 293 as the main carrousel 293 moves.

The straw 236 continues to rotate with the main carrousel 293 until the top of the straw 236 reaches the position directly beneath the open orifice 22 in the lid 20. The float 238 then exerts an upward force upon the straw 236 whenever there is sufficient beverage present in the beverage container 12. When the counteracting downward force of the closure tab 24 is removed, the float 238 elevates the straw 236 upward so that the straw 236 protrudes out through the top of the orifice 22 in the lid 20.

The optional stabilizing carrousel 280 may also be a component of the device 210 in those situations where the main carrousel 293 does not sufficiently stabilize and maintain the straw 236 in a position which is parallel to the inner side walls of the beverage container 12. The optional stabilizing carrousel 280 is secured to the drive stem 232 and functions in the same manner as the main carrousel 293 to act in concert with the main carrousel 293. The optional stabilizing carrousel 280 also adds additional stability in keeping the drive stem 232 parallel to the inner side walls of the beverage container 12.

As in the device 10, the outer diameters of the main carrousel 293 and optional stabilizing carrousel 280 are flexible to permit insertion past the smaller necked open end 18 of the container body 14 and to permit subsequent re-expansion to fit near the inner side walls of the container body 14.

Figure 5:
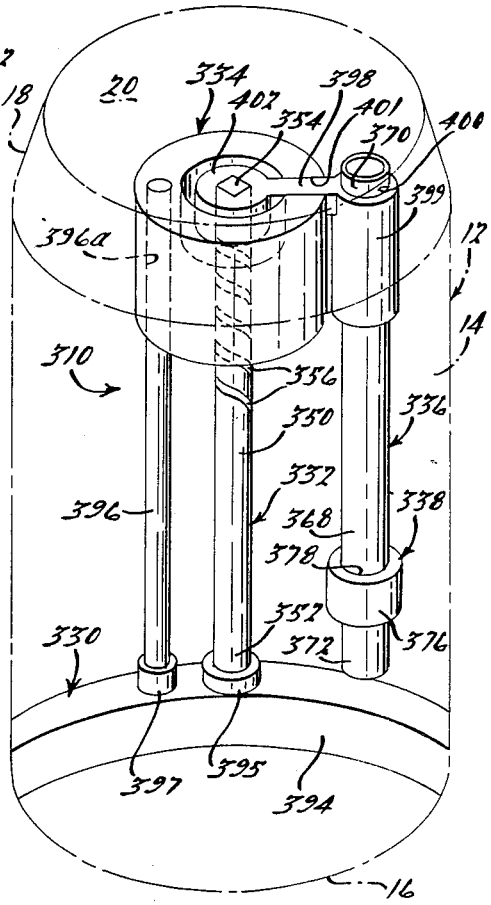
FIG. 5 is a perspective view of a second alternate embodiment of the device shown in FIGS. 1 and 2 with the beverage container shown in phantom lines.

Referring to FIG. 5, a second alternate embodiment 310 of the device 10 is shown. Like parts of the device 10 have like numerals increased by three hundred (300). In the device 310, the base mount 330 is a generally horizontally extending base bar 394 which extends across the interior surface of the closed end 16 of the body 14. Optionally, this base bar 394 may also contain a first boot or indentation 395 for the purpose of positioning the first end 352 of the drive stem 332 while still permitting rotation of the drive stem 332. The device 310 includes a stationary vertical stabilizing pin 396 extending through an aperture **396*a* in the drive disc 334 to prevent the drive disc 334 from rotating while allowing relative vertical movement between the drive disc 334 and stabilizing pin 396. The base of the stabilizing pin 396 is fixedly secured in a second boot 397 which is integrated with the base bar 394**.

In the device 310, the main carrousel is replaced by a swing arm 398 which is attached or integrally formed to the second end 354 of the drive stem 332 positioned at the open end 18 of the body 14. The swing arm 398 extends radially outwardly from the drive stem 332 and has a generally elongated cylindrical flange 399 at the end thereof. The flange 399 includes a positioning aperture 400 extending axially therethrough to allow the straw 336 to pass or extend through the flange 399. The stabilizing pin 396 is positioned inside the turning radius of the straw 336 and float 338. In addition, the drive disc 334 incorporates a recessed slot 401 to contain the swing arm 398 in a nested fashion flush with the top or upper surface of the drive disc 334 until the opening process begins.

The device 310 is used for situations wherein the drive disc 334 might tend to horizontally rotate about the drive stem 332 as it is pushed vertically downward by the closure tab 24 during the opening process of the beverage container 12. Horizontal rotation by the drive disc 334 is not desirable because this rotation would consume some or all of the limited energy available from the downwardly moving closure tab 24 instead of transmitting that same energy to cause the drive stem 332 to rotate. If the drive stem 332 does not rotate, the swing arm 398 will not rotate and the straw 336 may not become positioned beneath the orifice 22.

A few situations wherein the drive disc 334 might exhibit this unwanted rotation might include large diameter or tall height beverage containers or those situations wherein the beverage's viscosity, foam, or carbonation cause slippage between the edge of the descending closure tab 24 and the top or upper surface of the drive disc 334. Ideally, it is preferred that one hundred percent (100%) of the travel for the drive disc 334 will be vertically downward so that all of the force exerted by the moving closure tab 24 will be converted into rotary motion of the straw 336 and not wasted on rotary motion of the drive disc 334.

In case the stabilizing pin 396 interferes with the swing arm 398, the stabilizing pin 396 can be constructed so that its length decreases as the drive disc 334 descends. This can be accomplished by using a stabilizing tube (not shown) with compressible convoluted folds, a multiple-piece telescoping stabilizing tube or overlapping stabilizing bars. Alternatively, the stabilizing pin 396 could retain its length, yet descend further downward into the second boot 397 as it is pushed by the descending drive disc 334.

The edges of the swing arm 398 and the corresponding edges of the recessed slot 401 may be bevelled to facilitate the swing arm's rotation out of the drive disc 334 as the drive disc 334 is driven downward by the closure tab 24. In addition, the top or upper horizontal surface of the drive disc 334 and/or swing 398 be sized and/or contoured to divert the downwardly moving closure tab 24 onto the drive disc 334 in the rare case when the swing arm 398 happens to be positioned directly beneath the closure tab 24 prior to the opening of the container 12. Because this alternative embodiment precludes the use of the optional stabilizing carrousel 80 as previously described, the swing arm 398 is provided with collars 399 and 402 of sufficient vertical height to maintain the parallelism of the straw 336 with the inner side walls of the body 14 at all times.

As an alternative to the stationary vertical stabilizing pin 396, a brake sleeve (not shown) may be attached to the drive disc 334 to prevent the drive disc 334 from rotating. Such a brake sleeve could contain internal spiral threads or twists which mate with the threads of the lower portion of the drive stem 332, yet whose pitch and/or diameter differ from those of the drive disc 334 and the second end 354 of the drive stem 332. The force required to overcome the resistance of these different threads would counteract the tendency toward rotary motion of the drive disc 334 or an optional carrousel in such a way that all rotary motion would take place in the drive stem only. The brake sleeve would be attached to the drive disc 334 by means of one or more rigid extension arms (not shown) which would maintain constant vertical and horizontal alignment between the brake sleeve and drive disc 334.

Figure 6:
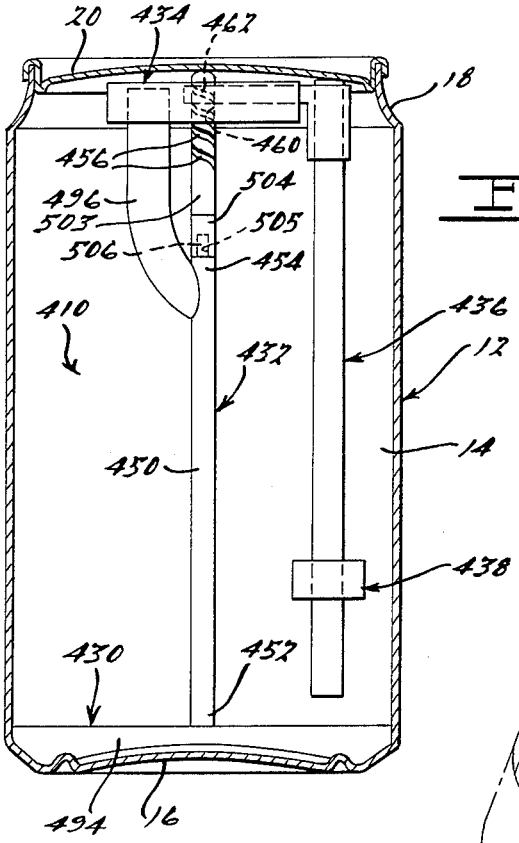
FIG. 6 is a view similar to FIG. 4 of a third alternate embodiment of the device shown in FIGS. 1 and 2.

Referring to FIG. 6, a third alternate embodiment 410 of the device 10 is shown. Like parts of the device 10 have like numerals increased by four hundred (400). The device 410 is similar to the device 310. The device 410 prevents rotary motion of the drive disc 434 by means of a combination two-piece drive stem 432. The drive stem 432 has a lower stem portion 450 and an upper stem portion 503. The upper stem portion 503 rotates while the lower stem portion 450 remains stationary. The upper stem portion 503 has at its lower end a coupling sleeve 504 which seats loosely over the second end 454 of the lower stem portion 450, maintaining concentric alignment between upper stem portion 503 and lower stem portion 450 while permitting the upper stem portion 503 to rotate. The coupling sleeve 504 may also have a horizontal relief groove 505 in its inside wall which can form a lock with a mating ridge 506 on the outer wall of the second end 454 of the lower stem portion 450 to prevent vertical separation of the upper stem portion 503 from the lower stem portion 450.

The first end 452 of the lower stem portion 450 is fixedly attached or integral to the base bar 494. The base bar 494 is in compression or adhesion fit to the beverage container 12 so that it will not horizontally rotate. Consequently, the lower stem portion 450 of the drive stem 432 will not rotate either. Attached or integral to the lower stem portion 450 of the drive stem 432 is the stabilizing pin 496 formed as an arm extending upwardly from the lower stem portion 450. The stabilizing pin 496 prevents horizontal or rotary motion of the drive disc 334 in a manner similar to the stabilizing pin 396 in the alternative embodiment depicted in FIG. 5.

Figure 7:
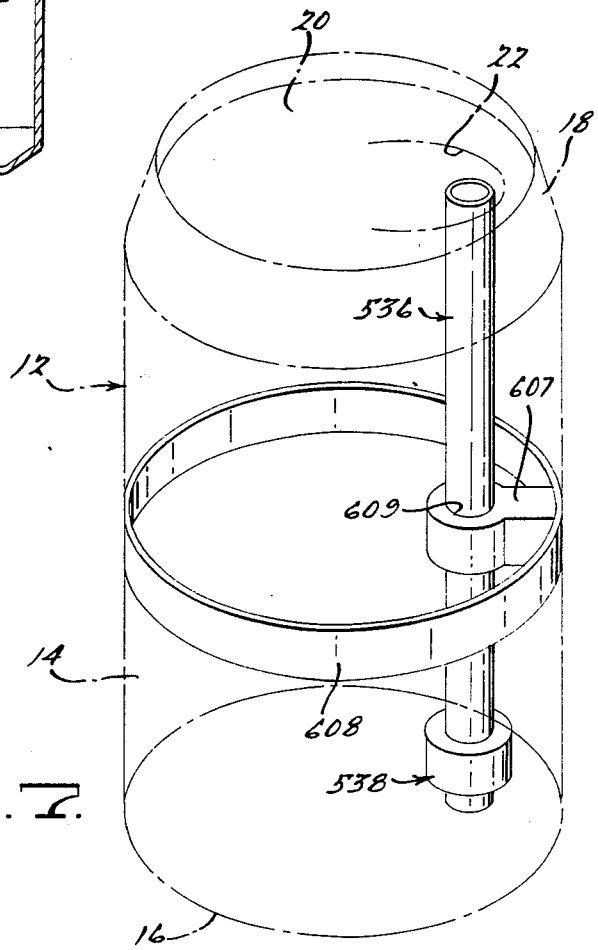
FIG. 7 is a view similar to FIG. 5 of a fourth alternate embodiment of the device shown in FIGS. 1 and 2.

Referring to FIG. 7, a fourth alternate embodiment 510 of the device 10 is shown. Like parts of the device 10 has like numerals increased by five hundred (500). The device 510 is used for situations where the device 510 is installed in beverage containers 12 whose lids 20 are consistently aligned either with the straw 536 or with their bodies 14 during the seaming operations so that the orifices 22 always match up with a pre-determined location of the container body 14. Such alignment will result from a sensing system (not shown) (vision, mechanical positioning, magnetic, bar-coded, proximity, photo-optical, etc.) which may be an integral part of the device 510 or which will use the device 510 to indicate its positioning. The device 510 provides for alignment of the straw 536 with the lid 20 and/or body 14 without necessitating the costly changes to the present state of the art which would be required to actually attach the straw 536 to the lid 20.

In the device 510, the straw 536 is held in place by a straw positioning arm 607 which is attached to a positioning band 608. The band 608 is compressible to allow for insertion past the narrow necked open end 18 of the body 14. Once the band 608 is inserted past the necked open end 18, the band 608 re-expands to fit under compression with the inner side walls of the container body 14. A sensor dot, bar-code, etc. (not shown) may be located at any suitable point on the straw 536, band 608, or positioning arm 607. When the closure tab 24 is deflected into the interior of the body 14, the float 538 elevates the straw 536 through the orifice 22 in the lid 20.

The float 538 which is attached to the straw 536 may be trapped in the bottom of the positioning arm 607 if the straw 536 is completely removed by the end-user. This will prevent the float 538 from being accidentally ingested by the end-user. The straw 536 may be secured in an aperture 609 of the positioning arm 607 using one or more of the mechanical or adhesion methods previously described.

The present invention is described in an illustrative manner. It is to be understood that the terminology which has been used is intended to be in the nature of words of description rather than of limitation.

Obviously, many modifications or variations of the present invention are possible in light of the above teachings. Therefore, within the scope of the appended claims, the present invention may be practiced otherwise than as specifically described.

What is claimed is:

1. A device for a container including a tubular body having a closed end and an open end and a longitudinal axis, a lid secured to the open end and having an orifice, a closure tab pivotally connected to the lid and temporarily closing the orifice, an actuating member pivotally secured to the lid and being manually actuated for moving the closure tab into the interior of the body to open the orifice, said device comprising:

a conduit disposed within the body;

means disposed within the body and adapted to engage the body for supporting said conduit substantially parallel to the longitudinal axis of the body;

means forming a float for elevating said conduit through the orifice in the lid when liquid is present within the body and the closure tab is deflected into the interior of the body to open the orifice; and including means for rotating said conduit to align said conduit with the orifice of the lid when the closure tab is deflected into the interior of the body to open the orifice by the actuating member.

2. The device as set forth in claim 1 wherein said support means comprises a base mount adapted to engage an interior longitudinal wall of the body, a rod supported by said base mount and extending along the longitudinal axis of the body, and means disposed about said rod and extending radially outwardly and disposed about said conduit for maintaining alignment of said conduit with the longitudinal axis.

3. The device as set forth in claim 2 wherein said rotating means comprises a moveable drive disc having an aperture and disposed about said rod, said rod having at least one raised flight, said drive disc having a groove about the circumference of said aperture for matingly engaging said raised flight.

4. The device as set forth in claim 3 wherein said groove and raised flight have the same pitch and are formed in a helical pattern.

5. The device as set forth in claim 3 wherein said rod is fixed relative to said base mount.

6. The device as set forth in claim 5 wherein said drive disc includes a flange extending radially outwardly and having a positioning aperture extending longitudinally therethrough, said conduit extending through said positioning aperture.

7. The device as set forth in claim 6 including means forming a carrousel for maintaining alignment of said conduit with the longitudinal axis.

8. The device as set forth in claim 7 wherein said carrousel comprises a plate fixed relative to said rod and extending radially outwardly and a ring member disposed about said plate and having an outer face.

9. The device as set forth in claim 8 wherein said float has an inner face for mating with and moving about said outer face of said ring member.

10. The device as set forth in claim 7 wherein said carrousel comprises a plate disposed about and rotatable relative to said rod and extending radially outwardly, and a ring member disposed about said plate and adapted to engage the inner longitudinal walls of the body.

11. The device as set forth in claim 10 wherein said base mount is fixed relative to said rod and has a plurality of radially outwardly extending legs adapted to engage the inner longitudinal walls of the body to resist relative movement between said base mount and the body.

12. The device as set forth in claim 3 wherein said rod is rotatable relative to said base mount.

13. The device as set forth in claim 12 including a swing arm having one end connected to said rod and extending radially outwardly to a second end having a positioning aperture extending longitudinally therethrough, said conduit extending through said positioning aperture.

14. The device as set forth in claim 13 wherein said drive disc includes a recess to allow said swing arm to be disposed at least flush with an upper surface of said drive disc.

15. The device as set forth in claim 14 including a stabilizing member fixed relative to either one of said rod and said base mount to resist rotational movement of said drive disc while allowing longitudinal movement of said drive disc relative to said stabilizing member.

16. A device for a container including a tubular body having a closed end and an open end and a longitudinal axis, a lid secured to the open end and having an orifice, a closure tab pivotally connected to the lid and temporarily closing the orifice, an actuating member pivotally secured to the lid and being manually actuated for moving the closure tab into the interior of the body to open the orifice, said device comprising:

a conduit disposed within the body;

means freely disposed within the body and resting on the closed end for supporting said conduit substantially parallel to the longitudinal axis of the body;

means forming a float for elevating said conduit through the orifice in the lid when liquid is present within the body and the closure tab is deflected into the interior of the body to open the orifice; and means operatively cooperating with said supporting means for rotating said conduit to align said conduit with the orifice of the lid when the closure tab is deflected into the body to open the orifice by the actuating member.

17. A device for a container including a tubular body having a closed end and an open end and a longitudinal axis, a lid secured to the open end and having an orifice, a closure tab pivotally connected to the lid and temporarily closing the orifice, an actuating member pivotally secured to the lid and being manually actuated for moving the closure tab into the interior of the body to open the orifice, said device comprising:

a conduit disposed within the body;

means disposed within the body for supporting said conduit substantially parallel to the longitudinal axis of the body;

means forming a float for elevating said conduit through the orifice in the lid when liquid is present within the body and the closure tab is deflected into the interior of the body to open the orifice;

means for rotating said conduit to align said conduit with the orifice of the lid when the closure tab is deflected into the body to open the orifice by the actuating member; and wherein said support means comprises a rod extending along the longitudinal axis of the body, and means disposed about said rod and extending radially outwardly and disposed about said conduit for maintaining alignment of said conduit with the longitudinal axis.

18. The device as set forth in claim 17 wherein said rotating means comprises a moveable device disc having an aperture and disposed about said rod, said rod having at least one raised flight, said drive disc having a groove about the circumference of said aperture for matingly engaging said raised flight.

19. A device for a container including a tubular body having a closed end and an open end and a longitudinal axis, a lid secured to the open end and having an orifice, a closure tab pivotally connected to the lid and temporarily closing the orifice, an actuating member pivotally secured to the lid and being manually actuated for moving the closure tab into the interior of the body to open the orifice, said device comprising:

a conduit disposed within the body;

means disposed within the body and adapted to engage the body for supporting said conduit substantially parallel to the longitudinal axis of the body;

means forming a float for elevating said conduit through the orifice in the lid when liquid is present within the body and the closure tab is deflected into the interior of the body to open the orifice;

means for rotating said conduit to align said conduit with the orifice of the lid when the closure tab is deflected into the body to open the orifice by the actuating member;

said support means comprising a base mount adapted to engage an interior longitudinal wall of the body, a rod supported by said base mount and extending along the longitudinal axis of the body, and means disposed about said rod and extending radially outwardly and disposed about said conduit for maintaining alignment of said conduit with the longitudinal axis;

said rotating means comprises a moveable device disc having an aperture and disposed about said rod, said rod having at least one raised flight, said drive disc having a groove about the circumference of said aperture for matingly engaging said raised flight;

wherein said rod is fixed relative to said base mount; and wherein said drive disc includes a flange extending radially outwardly and having a positioning aperture extending longitudinally therethrough, said conduit extending through said positioning aperture.

20. A device for a container including a tubular body having a closed end and an open end and a longitudinal axis, a lid secured to the open end and having an orifice, a closure tab pivotally connected to the lid and temporarily closing the orifice, an actuating member pivotally secured to the lid and being manually actuated for moving the closure tab into the interior of the body to open the orifice, said device comprising:

a conduit disposed within the body;

means disposed within the body and adapted to engage the body for supporting said conduit substantially parallel to the longitudinal axis of the body;

means forming a float for elevating said conduit through the orifice in the lid when liquid is present within the body and the closure tab is deflected into the interior of the body to open the orifice;

means for rotating said conduit to align said conduit with the orifice of the lid when the closure tab is deflected into the body to open the orifice by the actuating member;

said support means comprising a base mount adapted to engage an interior longitudinal wall of the body, a rod supported by said base mount and extending along the longitudinal axis of the body, and means disposed about said rod and extending radially outwardly and disposed about said conduit for maintaining alignment of said conduit with the longitudinal axis;

said rotating means comprising a moveable device disc having an aperture and disposed about said rod, said rod having at least one raised flight, said drive disc having a groove about the circumference of said aperture for matingly engaging said raised flight;

wherein said rod is rotatable relative to said base mount;

a swing arm having one end connected to said rod and extending radially outwardly to a second end having a positioning aperture extending longitudinally therethrough, said conduit extending through said positioning aperture; and a stabilizing member fixed relative to either one of said rod and said base mount to resist rotational movement of said drive disc while allowing longitudinal movement of said drive disc relative to said stabilizing member.

21. A device for a container including a tubular body having a closed end and an open end and a longitudinal axis, a lid secured to the open end and having an orifice, a closure tab pivotally connected to the lid and temporarily closing the orifice, an actuating member pivotally secured to the lid and being manually actuated for moving the closure tab into the interior of the body to open the orifice, said device comprising:

a conduit disposed within the body;

means disposed within the body and adapted to engage the body for supporting said conduit substantially parallel to the longitudinal axis of the body;

means forming a float for elevating said conduit through the orifice in the lid when liquid is present within the body and the closure tab is deflected into the interior of the body to open the orifice;

said support means comprising a deflectable band adapted to engage an interior longitudinal wall of the body and a positioning arm extending inwardly from said band and having an aperture extending therethrough, said conduit extending through said aperture and aligned with the orifice of the lid; and wherein said float is secured about said conduit below said positioning arm and being made of a material having a density less than the density of a liquid present in the container.

* * * * *